US009670857B2

(12) United States Patent
Kar et al.

(10) Patent No.: US 9,670,857 B2
(45) Date of Patent: Jun. 6, 2017

(54) TORQUE CONTROL OF A POWER-PLANT FOR LAUNCHING A VEHICLE WITH A MANUAL TRANSMISSION

(71) Applicant: GM GLOBAL TECHNOLOGY OPERATIONS LLC, Detroit, MI (US)

(72) Inventors: Krishnendu Kar, South Lyon, MI (US); Leon Cribbins, Dexter, MI (US); Thomas Weglarz, Farmington Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 128 days.

(21) Appl. No.: 14/828,007

(22) Filed: Aug. 17, 2015

(65) Prior Publication Data

US 2017/0051695 A1 Feb. 23, 2017

(51) Int. Cl.

| | |
|---|---|
| ***F02D 41/10*** | (2006.01) |
| ***F02D 41/02*** | (2006.01) |
| ***F02D 11/10*** | (2006.01) |
| ***F02D 41/14*** | (2006.01) |
| ***F02D 41/00*** | (2006.01) |
| ***F02D 41/08*** | (2006.01) |

(52) U.S. Cl.

CPC ..... *F02D 41/10* (2013.01); *F02D 11/105* (2013.01); *F02D 11/106* (2013.01); *F02D 41/0097* (2013.01); *F02D 41/022* (2013.01); *F02D 41/08* (2013.01); *F02D 41/1402* (2013.01); *F02D 2041/1409* (2013.01)

(58) Field of Classification Search

CPC .... F02D 41/10; F02D 41/0097; F02D 41/022; F02D 41/08; F02D 41/1402; F02D 11/105; F02D 11/106

See application file for complete search history.

(56) References Cited

U.S. PATENT DOCUMENTS

| | | | | |
|---|---|---|---|---|
| 3,093,010 A * | 6/1963 | Spreitzer | ..... | F02C 7/36 180/301 |
| 4,492,112 A * | 1/1985 | Igarashi | ..... | F16H 63/42 701/123 |
| 8,332,127 B2 * | 12/2012 | Gwidt | ..... | F02D 37/02 123/406.11 |

* cited by examiner

*Primary Examiner* — Hieu T Vo

(74) *Attorney, Agent, or Firm* — Quinn IP Law

(57) ABSTRACT

A method of controlling torque output of a power-plant during launch of a vehicle having a transmission with a manually-operated clutch is disclosed. The power-plant torque is varied based on clutch pedal and throttle pedal positions using a proportional-integral-derivative (PID) control logic in an electronic fuel control system. The method includes setting power-plant idle speed, detecting clutch engagement without application of the throttle pedal, and raising power-plant torque after clutch engagement is detected. In each PID feedback loop, the method includes detecting actual power-plant speed and a rate of change in actual power-plant speed, and adjusting the raised power-plant torque in response to the determined rate of change in actual power-plant speed. The method additionally includes determining a difference between the set idle speed and the actual power-plant speed, and maintaining constant power-plant torque, if the difference between the set idle and actual power-plant speeds is within an acceptable range.

20 Claims, 2 Drawing Sheets

TORQUE CONTROL OF A POWER-PLANT FOR LAUNCHING A VEHICLE WITH A MANUAL TRANSMISSION

TECHNICAL FIELDT

The disclosure relates to electronic control of power-plant torque during launch of a vehicle with a manual transmission.

BACKGROUND

Various power-plants, such as internal combustion engines, electric motors, and/or fuel cells, can be employed to power vehicles. Modern internal combustion engines typically employ electronic fuel control to regulate engine output torque. In a gasoline engine, an amount of air supplied to the engine is controlled via an electronic throttle control (ETC) to establish the amount of injected fuel, and thereby regulate the engine's output torque. On the other hand, in modern diesel internal combustion engines, the engine's output torque control is typically accomplished directly via regulation of injected fuel.

Some modern vehicles employ manually operated, i.e., manual, transmissions for transmitting engine torque to driven wheels. Such manual transmissions are generally characterized by gear ratios that are selectable by locking selected gear pairs to the output shaft inside the transmission. A vehicle using such a manual transmission may employ a manually-operated clutch for regulating torque transfer from the vehicle's engine to its transmission.

Commonly, such a clutch is operated by a foot pedal in order to disconnect the vehicle's engine from its transmission and permit starting the vehicle from rest, as well as to facilitate selection of the transmission gear ratios when the vehicle is in motion. The actual selection of the gear ratios inside the manual transmission is typically accomplished via a shift lever movable by the vehicle operator.

SUMMARY

A method of controlling torque output of a power-plant during launch of a vehicle having a manual transmission is disclosed. The manual transmission is coupled to the power-plant via a manually-operated clutch. The power-plant has an actuator, which, in an internal combustion engine, can be an electronic fuel control (EFC) system operatively connected to an accelerator or throttle pedal. Such an EFC system may be employed in either a gasoline or a diesel internal combustion engine. In a gasoline engine, the EFC may employ electronic throttle control (ETC) to vary an amount of air used by the engine and thereby regulate engine output torque, while in a diesel engine, typically, the EFC will control an amount of injected fuel to directly regulate engine output torque. The vehicle also includes a controller in operative communication with the actuator, wherein the controller is programmed with a proportional-integral-derivative (PID) control logic. The method includes setting a power-plant idle speed via the controller. The method also includes detecting an engagement of the clutch without application of the throttle pedal. The method additionally includes commanding the actuator to raise the power-plant torque output by a first torque value after the engagement of the clutch is detected.

In each successive feedback loop of the PID control logic, the method also includes detecting an actual power-plant speed and a rate of change in the actual power-plant speed, and commanding the controller to adjust, i.e., either reduce or increase, the raised power-plant torque output in response to the determined rate of change in the actual power-plant speed. The method additionally includes determining via the controller a difference between the set power-plant idle speed and the actual power-plant speed. Furthermore, the method includes commanding the actuator to maintain constant power-plant torque output, if the determined difference between the set power-plant idle speed and the actual power-plant speed is within an acceptable range.

The act of commanding the actuator to adjust the raised power-plant torque output in response to the determined rate of change in the actual power-plant speed may include commanding the actuator to reduce the raised power-plant torque output by a second torque value, if the determined rate of change in the actual power-plant speed is positive and numerically greater than or equal to a predetermined value. The subject act of commanding the actuator may also include commanding the actuator to reduce the raised power-plant torque output by a third torque value, if the determined rate of change in the actual power-plant speed is positive and numerically smaller than the predetermined value. The same act of commanding the actuator may additionally include commanding the actuator to increase the raised power-plant torque output by a fourth torque value, if the determined rate of change in the actual power-plant speed is negative and numerically greater than or equal to the predetermined value. Furthermore, the same act of commanding the actuator may include commanding the actuator to increase the raised power-plant torque output by a fifth torque value, if the determined rate of change in the actual power-plant speed is negative and numerically smaller than the predetermined value.

The method may also include detecting that the engagement of the clutch was aborted. In such a case, the method may additionally include, in each successive feedback loop of the PID control logic after the engagement of the clutch was aborted, detecting the actual power-plant speed and the rate of change in the actual power-plant speed, and commanding the actuator to reduce the raised power-plant torque output in response to the determined rate of change in the actual power-plant speed. Furthermore, the method may include commanding the actuator to maintain constant power-plant torque output, if the engagement of the clutch was aborted and the determined difference between the set power-plant idle speed and the actual power-plant speed is within the acceptable range.

The vehicle may include a clutch pedal configured to selectively release and engage the manually-operated clutch. In such a case, each of the acts of detecting the engagement of the clutch and detecting that the engagement of the clutch was aborted may be accomplished via a clutch pedal position sensor in electronic communication with the controller.

The act of commanding the actuator, in each successive feedback loop of the PID control logic after the engagement of the clutch was aborted, to reduce the raised power-plant torque output in response to the determined rate of change in the actual power-plant speed may include commanding the actuator to reduce the raised power-plant torque output by the second torque value, if the engagement of the clutch was aborted, and the determined rate of change in the actual power-plant speed is positive and numerically greater than or equal to the predetermined value. The subject act of commanding the actuator may also include commanding the actuator to reduce the raised power-plant torque output by the third torque value, if the engagement of the clutch was aborted, and the determined rate of change in the actual power-plant speed is positive and numerically smaller than the predetermined value.

The second torque value may be greater than the third torque value, the fourth torque value may be equal to the second torque value, and the fifth torque value may be equal to the third torque value.

The method may additionally include commanding the actuator to maintain a constant change in the power-plant torque output if the rate of change in the actual power-plant speed is zero.

The acceptable range for difference between the set power-plant idle speed and the actual power-plant speed may be set at 0-20 RPM.

A vehicle, such as above, having a controller configured to perform the above-described method is also provided.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
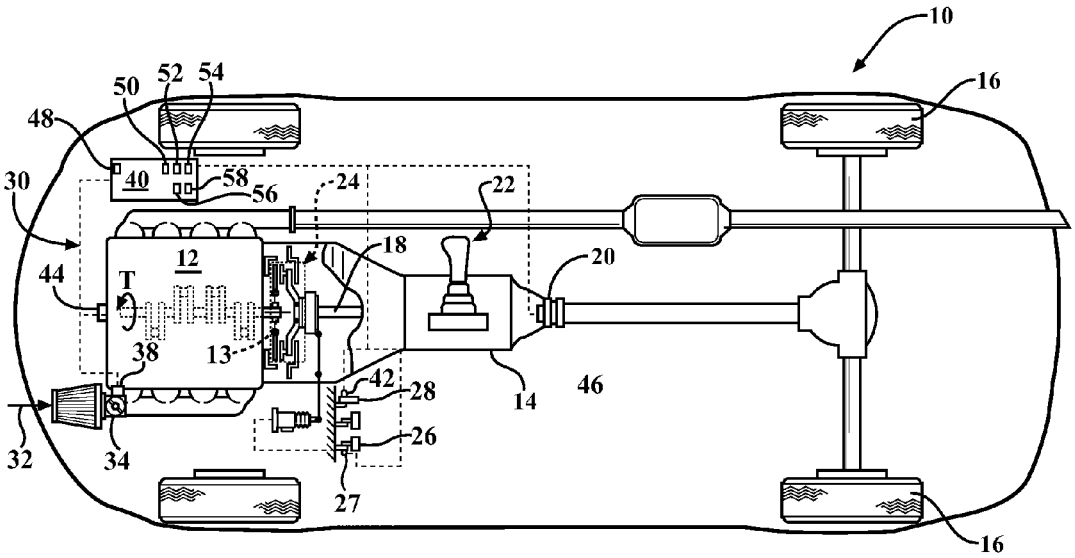
FIG. 1 is a schematic illustration of a vehicle having an embodiment of a power-plant with an actuator for regulating power-plant output torque depicted as an internal combustion engine with electronic fuel control, and a manual transmission coupled to the power-plant via a manually-operated clutch.

Referring to the drawings, wherein like reference numbers refer to like components, FIG. 1 shows a schematic illustration of a vehicle 10. The vehicle 10 includes a power-plant. Although the remainder of the present disclosure concentrates on the power-plant 12 being an internal combustion engine, the power-plant can also, for example, be one or more electric motors, or a hybrid-electric device including the engine, a fuel cell, and/or one or more such electric motors.

The internal combustion engine generally includes a crankshaft 13 operatively connected to a manual, i.e., manually shiftable, transmission 14. The manual transmission 14 is configured to receive engine output torque T from a crankshaft 13 and transmit the torque to the drive wheels 16. The subject engine may be either a spark-ignition, i.e., gasoline, internal combustion engine, or a compression-ignition, i.e., diesel, internal combustion engine. The manual transmission 14 is characterized by a plurality of internal shiftable gears (not shown) that are assembled into a gear train and are configured to provide multiple gear ratios between an input shaft 18 and an output shaft 20 of the transmission 14. The gear ratios of the manual transmission 14 are selectable by locking appropriate internal gear pairs to the output shaft 20.

Vehicle 10 also includes a movable shift lever 22 that is mechanically connected to the manual transmission 14. The shift lever 22 is operable to shift the transmission gears and thereby select desired gear ratios. The shift lever 22 extends into a passenger compartment of the vehicle 10 and is positioned such that an operator or driver of the vehicle 10 may conveniently reach the lever to select desired gear ratios in the manual transmission 14 while operating the vehicle. The vehicle 10 also includes a selectively releasable and re-engageable clutch 24 that is operated by the driver for regulating torque transfer from power-plant 12, e.g., from the crankshaft 13 of the engine, to the manual transmission 14. Although the vehicle 10 is depicted as having a rear-wheel-drive architecture, nothing precludes the subject vehicle from having other architectures, such as a front- or a four-wheel-drive type.

As understood by those skilled in the art, without the clutch 24, the power-plant 12 and the drive wheels 16 would at all times be continuously linked, and any time the vehicle 10 stopped, the power-plant would stall. Accordingly, a disengaged clutch 24 would be beneficial for starting the power-plant 12 in a stationary vehicle 10. Additionally, without the clutch 24, selecting desired gear ratios inside the manual transmission 14 would be challenging, even with the vehicle 10 already in motion, because deselecting a gear while the manual transmission is under load typically requires considerable force. Also, selecting a desired gear ratio in the manual transmission 14 while the vehicle 10 is in motion requires the rotational speed of power-plant 12 to be held at a specific value, which depends on the rotational speed of drive wheels 16, as well as on the desired gear ratio.

As shown, the clutch 24 is operated by the driver of the vehicle via a clutch pedal 26. When the clutch pedal 26 is fully depressed, the clutch 24 is fully disengaged, and none of the output torque T is transferred from the power-plant 12 to the transmission 14, and therefore no torque is transferred from the transmission to the drive wheels 16. Thus, when the clutch 24 is disengaged, it is possible to select gear ratios or to stop the vehicle 10 without stopping or stalling the power-plant 12. When the clutch pedal 26 is fully released, the clutch 24 becomes fully engaged, and practically all the output torque T of the power-plant 12 is transferred to the transmission 14. In this fully engaged state, the clutch 24 does not slip, but rather acts as a rigid coupling such that the output torque T is transmitted to the drive wheels 16 with minimal loss in operating efficiency. Specific travel of the clutch pedal 26 may be detected via a clutch pedal position sensor 27, and a point where initial engagement of the clutch 24 occurs may be either calculated or empirically identified with respect to the detected clutch pedal travel.

Between the above described extremes of engagement and disengagement, the clutch 24 slips to varying degrees. When the clutch 24 slips, it still transmits some measure of output torque T despite the difference in speeds between the output of the power-plant 12 and the input to the transmission 14. Because during slippage of the clutch 24, the output torque T is transmitted by means of frictional contact rather than a direct mechanical connection, the fraction of the output torque not used to drive the wheels 16 is absorbed by the clutch and then dissipated to the ambient as heat. When clutch slip is properly applied, such slip allows the vehicle 10 to be started from a standstill, and when the vehicle is already moving, clutch slip allows rotation of the power-plant 12 to gradually adjust to a newly selected gear ratio. The vehicle 10 also includes an accelerator or throttle pedal 28 configured to facilitate driver control over the power-plant output torque T for propelling the vehicle. The throttle pedal 28 is operatively connected to an actuator 30 operable to regulate torque output of the power-plant 12, such as the internal combustion engine. In the depicted internal combustion engine, the actuator 30 is configured as an electronic fuel control (EFC) system. Specifically, the EFC system can be configured to regulate an amount of intake air 32 used by the engine for combustion and thus regulate the output torque T. To achieve desired starting of the vehicle 10 from standstill, as well as gear changes in the transmission 14, the throttle pedal 28 is typically operated by the driver of the vehicle in concert with the clutch pedal 26. However, in situations where low speed vehicle creep is desired, such as in heavy traffic or to adjust vehicle position in a parking space, the clutch pedal 26 may be operated to engage the clutch 24 without using the throttle pedal 28.

For illustrative purposes, in FIG. 1 the power-plant 12 is depicted as a gasoline internal combustion engine having an embodiment of the EFC system that in gasoline engines is generally known as electronic throttle control (ETC). The ETC includes a throttle valve 34 arranged in an air duct 36 upstream of the engine and operative to control an amount of the intake air 32 used by the engine for combustion. As also shown, the ETC includes an electric motor 38 configured to operate the throttle valve 34 and an electronic controller 40 configured to regulate operation of the throttle valve based on a signal indicative of position of the throttle pedal 28. The controller 40 is an embedded system that employs software to determine the required position of the throttle valve 34 via calculations based on data acquired by various sensors, including a throttle pedal position sensor 42 for sensing the above-noted position of the throttle pedal 28, an engine speed sensor 44, and a vehicle speed sensor 46. The electric motor 38 is used to open the throttle valve 34 to a desired angle via a closed-loop control algorithm programmed into the controller 40 permitting a specific amount of intake air 32 to enter the engine. Additionally, the controller 40 is programmed to inject a specific amount of fuel, corresponding to the amount of intake air 32, into the engine for generating a desired level of output torque T. As such, the ETC electronically "connects" the throttle pedal 28 to the engine, in place of a mechanical linkage, for driving the vehicle 10.

As known, in the diesel type of engine, the EFC system typically regulates an amount of fuel injected into the engine via the controller 40, to thereby directly control the engine's output torque. Due to the fact that in diesel engines the amount of fuel delivered by fuel injectors (not shown, but known to those skilled in the art) is controlled to directly control engine torque, many diesel engines do not employ a throttle valve 34. In a diesel type engine, the EFC system electronically "connects" the accelerator or throttle pedal 28 to the fuel injectors in the engine via the controller 40 for driving the vehicle 10. As such, the EFC system for a diesel type of engine, where the subject engine either includes or specifically excludes the throttle valve 34 (not shown), is expressly within the scope of the present disclosure. In such a case, the EFC will regulate operation of the fuel injectors directly to control engine torque output during launch of the vehicle 10, as described in detail below.

The controller 40 may be a dedicated controller for the power-plant 12, a controller for the powertrain that includes both the power-plant and the manual transmission 14, or a central processing unit for the entire vehicle 10. The controller 40 includes a memory, at least some of which is tangible and non-transitory. The memory may be any recordable medium that participates in providing computer-readable data or process instructions. Such a medium may take many forms, including but not limited to non-volatile media and volatile media. Non-volatile media for the controller 40 may include, for example, optical or magnetic disks and other persistent memory. Volatile media may include, for example, dynamic random access memory (DRAM), which may constitute a main memory. Such instructions may be transmitted by one or more transmission medium, including coaxial cables, copper wire and fiber optics, including the wires that comprise a system bus coupled to a processor of a computer. Memory of the controller 40 may also include a floppy disk, a flexible disk, hard disk, magnetic tape, any other magnetic medium, a CD-ROM, DVD, any other optical medium, etc. The controller 40 can be configured or equipped with other required computer hardware, such as a high-speed clock, requisite Analog-to-Digital (A/D) and/or Digital-to-Analog (D/A) circuitry, any necessary input/output circuitry and devices (I/O), as well as appropriate signal conditioning and/or buffer circuitry. Any algorithms required by the controller 40 or accessible thereby may be stored in the memory and automatically executed to provide the required functionality.

Figure 2:
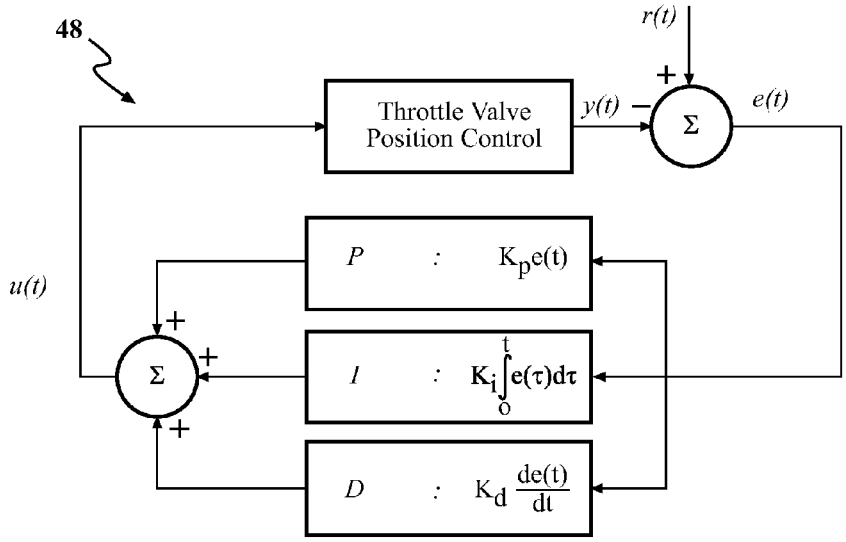
FIG. 2 is an illustration of representative proportional-integral-derivative (PID) control logic used to regulate power-plant output torque.

In accordance with the disclosure, the controller 40 is programmed with a proportional-integral-derivative (PID) feedback control logic 48. As shown in FIG. 2, the PID logic 48 provides a control loop feedback mechanism that calculates an error value as the difference between a measured process variable and a desired setpoint. PID feedback 48 is intended to minimize error e(t) in rotational speed, indicated at r(t) in FIG. 2, of the power-plant 12 by adjusting the power-plant output torque T via varying the position of throttle valve 34. Generally, the PID logic 48 involves three separate constant parameters or factors: a proportional (P) factor, an integral (I) factor, and a derivative (D) factor. Each of the P, I, and D factors can be interpreted in terms of time, wherein P depends on a present error in rotational speed of the power-plant 12, I depends on an accumulation of past errors of the power-plant rotational speed, and D is a prediction of such errors in the future, based on a current rate of change of the rotational speed. The weighted sum, indicated at u(t) in FIG. 2, of the present error, accumulated past errors, and the prediction of future errors is used to adjust the delivery of the intake air 32 to the power-plant 12 by adjusting position, indicated at y(t) in FIG. 2, of the throttle valve 34. During operation of the power-plant 12, for effective control of power-plant performance, each PID feedback loop of the PID logic 48 may extend for a duration of 12-13 milliseconds (msec).

The controller 40 is configured to set an idle speed 50 of the power-plant 12 and an initial power-plant torque output T0 via selecting a predetermined position of the throttle valve 34. The controller 40 is also configured to detect an engagement of the clutch 24 without application of the throttle pedal 28. As described above, engagement of the clutch pedal 26 may be detected via the clutch pedal position sensor 27, and then communicated by the sensor 27 to the controller 40. The controller 40 is also configured to command the actuator 30 to raise the initial power-plant torque output T0 by a first torque value T1, for a resultant raised power-plant torque output (T0+T1), after the engagement of clutch 24 is detected. Such raising of the power-plant torque output T0 freezes the above-mentioned I factor in the initial PID feedback loop of the PID logic 48. In each successive (n+1) PID feedback loop once the engagement of clutch 24 is detected and following raising of the power-plant torque output T0 by the first torque value T1, the controller 40 is configured to develop and shape the I factor in the PID logic 48. Specifically, the controller 40 is configured to detect a current or actual power-plant speed 52 and a rate of change 54 in the actual power-plant speed. In each successive (n+1) PID feedback loop, the controller 40 is additionally configured to command the actuator 30 to adjust, i.e., either reduce or increase, the raised power-plant torque output (T0+T1) in response to the determined rate of change 54 in the actual power-plant speed 52. If it is determined that the rate of change 54 in the actual power-plant speed 52 is zero, the controller 40 may be additionally configured to command the actuator 30 to maintain a constant change in the power-plant torque output T. In other words, if the actual power-plant speed 52 sees a constant change in successive (n+1) PID feedback loop 48, the actuator 30 can maintain the same change in the power-plant torque output T in the feedback loop (n+1) as in the previous feedback loop n.

Specifically, the command to either reduce or increase the raised power-plant torque output (T0+T1) in response to the determined rate of change 54 in the actual power-plant speed 52 may include selectively commanding the actuator 30 by the controller 40, as follows below. In a first mode, the actuator 30 may be commanded to reduce the raised power-plant torque output (T0+T1) by a second torque value T2 if the determined rate of change 54 in the actual power-plant speed 52 is positive and numerically greater than or equal to a predetermined or threshold value 56. Alternatively, in a second mode the actuator 30 may be commanded to reduce the raised power-plant torque output (T0+T1) by a third torque value T3 if the determined rate of change 54 in the actual power-plant speed 52 is positive and numerically smaller than the predetermined value 56. Alternatively again, in a third mode, the actuator 30 may be commanded to increase the raised power-plant torque output (T0+T1) by a fourth torque value T4 if the determined rate of change 54 in the actual power-plant speed 52 is negative and numerically greater than or equal to the predetermined value 56. Alternatively yet again, in a fourth mode the actuator 30 may be commanded to increase the raised power-plant torque output (T0+T1) by a fifth torque value T5 if the determined rate of change 54 in the actual power-plant speed 52 is negative and numerically smaller than the predetermined value 56. The predetermined value 56 may be established empirically during testing of the power-plant 12. Specifically the predetermined value 56 may be set at around 50 RPM per PID feedback loop 48.

The second torque value T2 may be set greater than the third torque value T3, such that in the first mode the raised power-plant torque output (T0+T1) would be reduced by a greater value than in the second mode. The fourth torque value T4 may be set equal to the second torque value T2 and the fifth torque value T5 may be set equal to the third torque value T3, such that in the third mode the raised power-plant torque output (T0+T1) would be increased by a greater value than in the fourth mode. Using such comparative magnitudes of the second, third, fourth, and fifth, T1-T5, torque values by the controller 40 would permit an appropriate amount of output torque T to be generated for launching the vehicle 10 without application of the throttle pedal 28, while quickly converging on a desired steady power-plant speed, such as the set idle speed 50.

The controller 40 is also configured to determine a difference between the set power-plant idle speed 50 and the actual power-plant speed 52. Additionally, the controller 40 is configured to command the actuator 30 to maintain constant power-plant torque output T at the level presently being generated by the power-plant 12, if the determined difference between the set power-plant idle speed 50 and the actual power-plant speed 52 is determined to be within an acceptable range 58. Accordingly, in the above described situation, the power-plant torque output T may be kept constant by the controller 40 via the throttle valve 34 at the level that results in the difference between the set power-plant idle speed 50 and the actual power-plant speed 52 being maintained within the acceptable range 58. The acceptable range 58 for difference between the set power-plant idle speed 50 and the actual power-plant speed 52 may be set to correspond to precision and control capability of the actuator 30 over the power-plant speed and torque output, for example 0-20 RPM.

The controller 40 may be additionally configured to detect via the clutch pedal position sensor 27 if the engagement of the clutch 24 was aborted at feedback loop n. Subsequent to the detection that the engagement of clutch 24 was aborted, in every successive (n+1) PID feedback loop, the controller may detect the actual power-plant speed 52 and the rate of change 54 in the actual power-plant speed. Additionally, if the engagement of the clutch 24 was aborted, the controller 40 may command the actuator 30 to reduce the raised power-plant torque output (T0+T1) in response to the determined rate of change 54 in the actual power-plant speed 52. Furthermore, if the engagement of the clutch 24 was aborted and the determined difference between the set power-plant idle speed 50 and the actual power-plant speed 52 is determined to be within the acceptable range 58, the controller 40 may command the actuator 30 to maintain constant power-plant torque output at the level being presently generated by the power-plant 12.

Specifically, the command to reduce the raised power-plant torque output (T0+T1) in response to the determined rate of change 54 in the actual power-plant speed 52 at every successive (n+1) PID feedback loop after the engagement of the clutch 24 was aborted may include selectively commanding the actuator 30 by the controller 40, as follows below. In a fifth mode, the actuator 30 may be commanded to reduce the raised power-plant torque output (T0+T1) by the second torque value T2, if the engagement of the clutch 24 was aborted and the determined rate of change 54 in the actual power-plant speed 52 is positive and numerically greater than or equal to the predetermined value 56. Alternatively, in a sixth mode, the actuator 30 may be commanded to reduce the raised power-plant torque output (T0+T1) by the third torque value T3, if the engagement of the clutch 24 was aborted and the determined rate of change 54 in the actual power-plant speed 52 is positive and numerically smaller than the predetermined value 56. Such commanding of the actuator 30 is intended to minimize the possibility of the power-plant 12 experiencing a speed flare in the event of an aborted engagement of the clutch 24. Additionally, the controller 40 may trigger the PID logic 48 in the event of a sequence detected by the sensor 27 where the clutch 24 was first released via the clutch pedal 26, but then the clutch pedal was moved from its bottom of travel, or clutch fully disengaged, position toward engaging the clutch, and then returned to clutch fully disengaged position. The above described sequence may signify that the vehicle operator has initially planned to engage the clutch 24, but then reconsidered and aborted the clutch engagement. Triggering the PID logic 48 in the event of such a sequence is intended to minimize the possibility of the power-plant 12 experiencing a stall.

Figure 3:
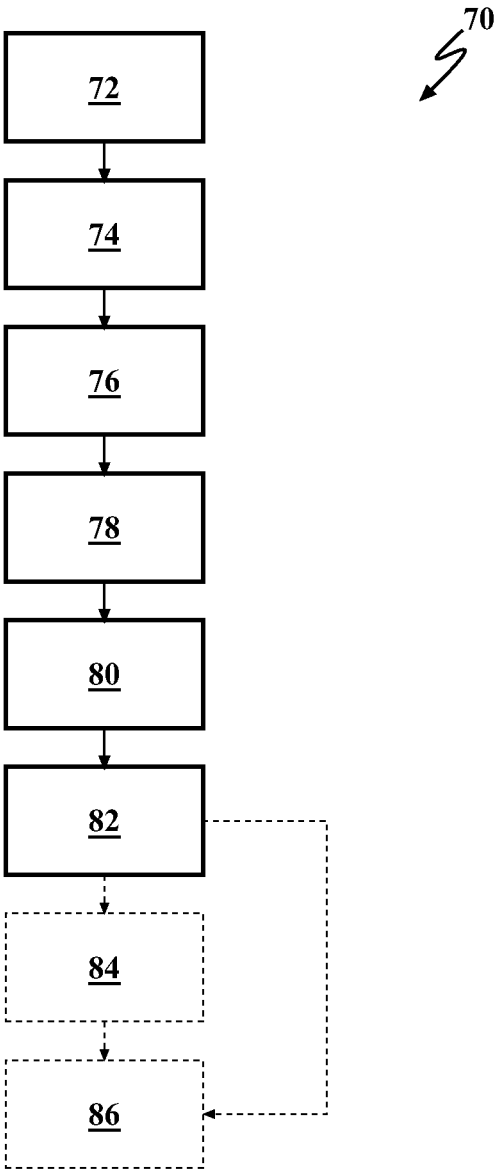
FIG. 3 is a flow diagram of a method of controlling torque output of a power-plant in a vehicle, such as shown in FIG. 1.

Referring to the drawings, wherein like reference numbers refer to like components, FIG. 3 shows a flow diagram of a method 70. The method 70 is configured to control torque output T of the power-plant 12 during launch of the vehicle 10 having the throttle pedal 28, the manual transmission 14, and the manually-operated clutch 24, as described in detail above with respect to FIGS. 1 and 2. As described with respect to FIGS. 1 and 2, although the power-plant 12 may include any combination of an internal combustion engine and/or an electric motor(s), for exemplary purposes the power-plant discussed herein is the internal combustion engine equipped with the actuator 30 configured as the EFC. The method commences in frame 72 with the controller 40 setting the idle speed 50 in the power-plant 12 via the throttle valve 34.

Following frame 72 the method proceeds to frame 74. In frame 74 the method includes detecting an engagement of the clutch 24 without application of the throttle pedal 28. After frame 74, the method advances to frame 76, where it includes commanding the actuator, configured as the actuator 30 in the exemplary embodiment, to raise the initial power-plant torque output T0 by the first torque value T1 to (T0+T1) after the engagement of the clutch 24 is detected. After frame 76 is completed, the method proceeds to frame 78. In frame 78, in each successive (n+1) PID feedback loop of the PID control logic 48, the method includes detecting the actual power-plant speed 52, and also detecting the rate of change 54 in the actual power-plant speed and commanding the actuator 30 to one of reduce and increase the raised power-plant torque output (T0+T1) in response to the determined rate of change 54 in the actual power-plant speed 52.

As described above with respect to FIG. 1, commanding the actuator 30 to one of reduce and increase the raised power-plant torque output (T0+T1) in response to the determined rate of change 54 in the actual power-plant speed 52 in frame 78 may specifically include the following four alternative modes of operation. In the first mode, the method 70 may include commanding the actuator 30 to reduce the raised power-plant torque output (T0+T1) by the second torque value T2, if the determined rate of change 54 in the actual power-plant speed 52 is positive and numerically greater than or equal to the predetermined value 56. In the second mode, the method 70 may include commanding the actuator 30 to reduce the raised power-plant torque output (T0+T1) by the third torque value T3, if the determined rate of change 54 in the actual power-plant speed 52 is positive and numerically smaller than the predetermined value 56. In the third mode, the method 70 may include commanding the actuator 30 to increase the raised power-plant torque output (T0+T1) by the fourth torque value T4, if the determined rate of change 54 in the actual power-plant speed 52 is negative and numerically greater than or equal to the predetermined value 56. In the third mode, the method 70 may include commanding the actuator 30 to increase the raised power-plant torque output (T0+T1) by the fifth torque value T5, if the determined rate of change 54 in the actual power-plant speed 52 is negative and numerically smaller than the predetermined value 56.

Following frame 78, the method advances to frame 80, where it includes determining via the controller 40 the difference between the set power-plant idle speed 50 and the actual power-plant speed 52. The method proceeds from frame 80 to frame 82, where the method includes commanding the actuator 30 to maintain constant power-plant torque output T if the determined difference between the set power-plant idle speed 50 and the actual power-plant speed 52 is within the acceptable range 58.

Following frame 82, the method may advance to frame 84, where the method includes detecting that the engagement of the clutch 24 was aborted. In the frame 84 the method also includes, in each successive (n+1) PID feedback loop, after the engagement of the clutch 24 was aborted, detecting the actual power-plant speed 52 and the rate of change 54 in the actual power-plant speed, and commanding the actuator 30 to reduce the raised power-plant torque output (T0+T1) in response to the determined rate of change in the actual power-plant speed. In frame 84 the method additionally includes commanding the actuator 30 to maintain constant power-plant torque output T, if the engagement of the clutch 24 was aborted and the determined difference 54 between the set power-plant idle speed 50 and the actual power-plant speed 52 is within the acceptable range 58.

Specifically, in frame 84 commanding the actuator 30 to reduce the raised power-plant torque output (T0+T1) in response to the determined rate of change 54 in the actual power-plant speed 52 in each successive (n+1) PID feedback loop after the engagement of the clutch 24 was aborted the method may include as follows. The method may include commanding the actuator 30 to reduce the raised power-plant torque output (T0+T1) by the second torque value T2, if the engagement of the clutch 24 was aborted, and the determined rate of change 54 in the actual power-plant speed 52 is positive and numerically greater than or equal to the predetermined value 56. In the same frame, the method may additionally include commanding the actuator 30 to reduce the raised power-plant torque output (T0+T1) by the third torque value T3, if the engagement of the clutch 24 was aborted, and the determined rate of change 54 in the actual power-plant speed 52 is positive and numerically smaller than the predetermined value 56. The method 70 may conclude in frame 86 following either frame 82 or frame 84. In frame 86 the method includes the speed of the power-plant 12 being maintained at a steady level, and either the clutch 24 being fully engaged and the vehicle 10 being propelled by the torque output T or the vehicle remaining at rest and no torque flowing through the transmission 14.

Overall, the described method 70 permits an appropriate amount of output torque T to be generated for launching the vehicle 10 without application of the throttle pedal 28, or returning to a vehicle stationary mode in the event that the engagement of clutch 24 was aborted, while minimizing sag and flare in power-plant speed 52. Such sag and flare in power-plant speed 52, even with the clutch 24 disengaged, can negatively impact the vehicle operating experience. On the other hand, sag and flare in power-plant speed 52 while the clutch 24 is transmitting power-plant torque can cause a vehicle condition called "buck and bobble", where an unsteady speed of the power-plant 12 excites a resonance in the power-plant mounting structure (not shown) that alternatively thrusts the vehicle 10 forward and pulls the vehicle back against the vehicle's suspension (also not shown). Accordingly, the described method 70 benefits drivability, operator control, and overall enjoyment of the vehicle 10.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A vehicle comprising:

a power-plant;

a manual transmission coupled to the power-plant via a manually-operated clutch;

a throttle pedal operatively connected to the power-plant;

a clutch pedal configured to selectively release and engage the manually-operated clutch;

an electronic fuel control (EFC) system operatively connected to the throttle pedal; and a controller in operative communication with the EFC system, programmed with a proportional-integral-derivative (PID) control logic, and configured to:

set a power-plant idle speed;

detect an engagement of the clutch without application of the throttle pedal;

command the EFC system to raise the power-plant torque output by a first torque value after the engagement of the clutch is detected;

in each successive feedback loop of the PID control logic, detect an actual power-plant speed and a rate of change in the actual power-plant speed and command the EFC system to adjust the raised power-plant torque output in response to the determined rate of change in the actual power-plant speed;

determine a difference between the set power-plant idle speed and the actual power-plant speed; and command the EFC system to maintain constant power-plant torque output, if the determined difference between the set power-plant idle speed and the actual power-plant speed is within an acceptable range.

2. The vehicle of claim 1, wherein the command to adjust the raised power-plant torque output in response to the determined rate of change in the actual power-plant speed includes:

commanding the EFC system to reduce the raised power-plant torque output by a second torque value, if the determined rate of change in the actual power-plant speed is positive and numerically greater than or equal to a predetermined value;

commanding the EFC system to reduce the raised power-plant torque output by a third torque value, if the determined rate of change in the actual power-plant speed is positive and numerically smaller than the predetermined value;

commanding the EFC system to increase the raised power-plant torque output by a fourth torque value, if the determined rate of change in the actual power-plant speed is negative and numerically greater than or equal to the predetermined value; and commanding the EFC system to increase the raised power-plant torque output by a fifth torque value, if the determined rate of change in the actual power-plant speed is negative and numerically smaller than the predetermined value.

3. The vehicle of claim 2, wherein the controller is additionally configured to:

detect that the engagement of the clutch was aborted;

in each successive feedback loop of the PID control logic, after the engagement of the clutch was aborted, detect the actual power-plant speed and the rate of change in the actual power-plant speed, and command the EFC system to reduce the raised power-plant torque output in response to the determined rate of change in the actual power-plant speed; and command the EFC system to maintain constant power-plant torque output, if the engagement of the clutch was aborted and the determined difference between the set power-plant idle speed and the actual power-plant speed is within the acceptable range.

4. The vehicle of claim 3, further comprising a clutch pedal position sensor in electronic communication with the controller, wherein the controller detects each of the engagement of the clutch and that the engagement of the clutch was aborted via the clutch pedal position sensor.

5. The vehicle of claim 3, wherein the command to reduce the raised power-plant torque output in response to the determined rate of change in the actual power-plant speed in each successive feedback loop of the PID control logic, after the engagement of the clutch was aborted, includes:

commanding the EFC system to reduce the raised power-plant torque output by the second torque value, if the engagement of the clutch was aborted, and the determined rate of change in the actual power-plant speed is positive and numerically greater than or equal to the predetermined value; and commanding the EFC system to reduce the raised power-plant torque output by the third torque value, if the engagement of the clutch was aborted, and the determined rate of change in the actual power-plant speed is positive and numerically smaller than the predetermined value.

6. The vehicle of claim 5, wherein the second torque value is greater than the third torque value.

7. The vehicle of claim 5, wherein the fourth torque value is equal to the second torque value.

8. The vehicle of claim 5, wherein the fifth torque value is equal to the third torque value.

9. The vehicle of claim 1, wherein the controller is additionally configured to command the EFC system to maintain a constant change in the power-plant torque output if the rate of change in the actual power-plant speed is zero.

10. The vehicle of claim 1, wherein the acceptable range for difference between the set power-plant idle speed and the actual power-plant speed is 0-20 RPM.

11. A method of controlling torque output of a power-plant during launch of a vehicle having a manual transmission coupled to the power-plant via a manually-operated clutch, and wherein the power-plant has an actuator operatively connected to a throttle pedal, the method comprising:

setting a power-plant idle speed via a controller in operative communication with the actuator, wherein the controller is programmed with a proportional-integral-derivative (PID) control logic;

detecting an engagement of the clutch without application of the throttle pedal;

commanding the actuator to raise the power-plant torque output by a first torque value after the engagement of the clutch is detected;

in each successive PID feedback loop of the PID control logic, detecting an actual power-plant speed and a rate of change in the actual power-plant speed and commanding the actuator to adjust the raised power-plant torque output in response to the determined rate of change in the actual power-plant speed;

determining via the controller a difference between the set power-plant idle speed and the actual power-plant speed; and commanding the actuator to maintain constant power-plant torque output, if the determined difference between the set power-plant idle speed and the actual power-plant speed is within an acceptable range.

12. The method of claim 11, wherein said commanding the actuator to adjust the raised power-plant torque output in response to the determined rate of change in the actual power-plant speed includes:

commanding the actuator to reduce the raised power-plant torque output by a second torque value, if the determined rate of change in the actual power-plant speed is positive and numerically greater than or equal to a predetermined value;

commanding the actuator to reduce the raised power-plant torque output by a third torque value, if the determined rate of change in the actual power-plant speed is positive and numerically smaller than the predetermined value;

commanding the actuator to increase the raised power-plant torque output by a fourth torque value, if the determined rate of change in the actual power-plant speed is negative and numerically greater than or equal to the predetermined value; and commanding the actuator to increase the raised power-plant torque output by a fifth torque value, if the determined rate of change in the actual power-plant speed is negative and numerically smaller than the predetermined value.

13. The method of claim 12, further comprising:

detecting that the engagement of the clutch was aborted;

in each successive feedback loop of the PID control logic, after the engagement of the clutch was aborted, detecting the actual power-plant speed and the rate of change in the actual power-plant speed, and commanding the actuator to reduce the raised power-plant torque output in response to the determined rate of change in the actual power-plant speed; and commanding the actuator to maintain constant power-plant torque output, if the engagement of the clutch was aborted and the determined difference between the set power-plant idle speed and the actual power-plant speed is within the acceptable range.

14. The method of claim 13, wherein the vehicle includes a clutch pedal configured to selectively release and engage the manually-operated clutch, and wherein each of said detecting the engagement of the clutch and detecting that the engagement of the clutch was aborted is accomplished via a clutch pedal position sensor in electronic communication with the controller.

15. The method of claim 13, wherein said commanding the actuator to reduce the raised power-plant torque output in response to the determined rate of change in the actual power-plant speed in each successive feedback loop of the PID control logic, after the engagement of the clutch was aborted, includes:

commanding the actuator to reduce the raised power-plant torque output by the second torque value, if the engagement of the clutch was aborted, and the determined rate of change in the actual power-plant speed is positive and numerically greater than or equal to the predetermined value; and commanding the actuator to reduce the raised power-plant torque output by the third torque value, if the engagement of the clutch was aborted, and the determined rate of change in the actual power-plant speed is positive and numerically smaller than the predetermined value.

16. The method of claim 15, wherein the second torque value is greater than the third torque value.

17. The method of claim 15, wherein the fourth torque value is equal to the second torque value.

18. The method of claim 15, wherein the fifth torque value is equal to the third torque value.

19. The method of claim 11, further comprising commanding the actuator to maintain a constant change in the power-plant torque output, if the rate of change in the actual power-plant speed is zero.

20. The method of claim 11, wherein the acceptable range for difference between the set power-plant idle speed and the actual power-plant speed is 0-20 RPM.

* * * * *